US007686283B2

(12) United States Patent
Marchio

(10) Patent No.: US 7,686,283 B2
(45) Date of Patent: Mar. 30, 2010

(54) HIGH SECURITY GATE ASSEMBLY

(75) Inventor: Michael J. Marchio, Joliet, IL (US)

(73) Assignee: Secure Gate Systems, Inc.

( * ) Notice: Subject to any disclaimer, the term of this patent is extended or adjusted under 35 U.S.C. 154(b) by 0 days.

(21) Appl. No.: 11/728,926

(22) Filed: Mar. 27, 2007

(65) Prior Publication Data

US 2008/0237559 A1 Oct. 2, 2008

(51) Int. Cl.
*E04H 17/16* (2006.01)

(52) U.S. Cl. ..... 256/73; 256/11; 256/32; 49/504

(58) Field of Classification Search ..... 256/11, 256/25, 32, 33, 73; 49/394, 460, 462, 401, 49/402, 504
See application file for complete search history.

(56) References Cited

U.S. PATENT DOCUMENTS

| | | | | |
|---|---|---|---|---|
| 805,411 | A | 11/1905 | Clark | |
| 829,820 | A * | 8/1906 | Wiley | 256/11 |
| 943,873 | A | 12/1909 | Hope | |
| 1,105,252 | A | 7/1914 | Carstens | |
| 1,168,792 | A | 1/1916 | Dyer | |
| 1,233,230 | A * | 7/1917 | Hassett | 256/32 |
| 1,441,336 | A | 1/1923 | Flowers | |
| 1,794,467 | A * | 3/1931 | Lucas | 362/152 |
| 1,898,505 | A | 2/1933 | Soemer | |
| 2,180,670 | A | 11/1939 | Erickson | |
| 2,732,237 | A | 1/1956 | Kihn et al. | |
| 3,073,142 | A | 1/1963 | Stebbins | |
| 3,076,328 | A | 2/1963 | Rhodes et al. | |
| 3,204,606 | A * | 9/1965 | Parr et al. | 119/514 |
| 3,771,767 | A * | 11/1973 | Dougherty | 256/11 |
| 3,815,877 | A * | 6/1974 | Turner | 256/25 |
| 4,167,280 | A | 9/1979 | Godec et al. | |
| 4,181,335 | A | 1/1980 | Thoren | |
| 4,185,859 | A | 1/1980 | Cunningham | |
| 4,225,163 | A | 9/1980 | Hubbard et al. | |
| 4,630,396 | A | 12/1986 | Zvi et al. | |
| 4,631,528 | A | 12/1986 | Handel et al. | |
| 4,961,330 | A | 10/1990 | Evans | |
| 5,169,185 | A | 12/1992 | Slaybaugh et al. | |
| 5,253,905 | A | 10/1993 | Hutson | |
| D347,565 | S | 6/1994 | Cziko | |
| 5,379,821 | A * | 1/1995 | Pergolizzi et al. | 49/462 |
| 5,496,081 | A | 3/1996 | Rice | |
| 5,590,917 | A | 1/1997 | Brooks et al. | |
| 5,765,411 | A | 6/1998 | Rowan | |

(Continued)

*Primary Examiner*—Michael P Ferguson
(74) *Attorney, Agent, or Firm*—Meroni & Meroni, P.C.; Charles F. Meroni, Jr.; Christopher J. Scott

(57) ABSTRACT

A gate assembly prevents keyless ingress into, and enables keyless egress from, a gated area. The gate assembly comprises a gate frame and a gate. The gate frame comprises rectangular or 360 degree frame structure for maintaining a planar gate-receiving area despite ground deformations and the like. The gate comprises rectangular gate structure that defines a planar frame-engaging area. The gate-receiving area is greater in magnitude than the frame-engaging area. The gate further comprises a state of the art interior push bar latch for enabling keyless egress, and state of the art keyed lock for preventing keyless ingress into the gated or secure area. An inferior frame member is anchored in subterranean media for positioning the gate frame during installation for maintaining the gate-receiving area should ground deformations occur.

15 Claims, 7 Drawing Sheets

U.S. PATENT DOCUMENTS 5,802,765 A 9/1998 Vickery
5,967,215 A 10/1999 Needham et al.
6,010,117 A 1/2000 Doxey
6,102,451 A 8/2000 Merryman
6,145,897 A 11/2000 Locher
6,601,881 B2 8/2003 Mandell et al.
7,066,502 B1 6/2006 Makus
7,198,090 B1 * 4/2007 Kershaw ..... 49/460

* cited by examiner

HIGH SECURITY GATE ASSEMBLY

BACKGROUND OF THE INVENTION

1. Field of the Invention

The present invention relates to gate assembly, and more particularly, to a high security gate assembly for preventing keyless ingress into, and enabling keyless egress from, a secure or restricted area.

2. Description of the Prior Art

So-called pre-exit gates suffer from misalignments due to ground deformations as resulting from frost-thaw cycles. Persons charged with activity within a secure area often require a safe egress route from the secure area in the event of an emergency. Misaligned gate assemblies can result in an unsafe egress route insofar as the gate may have become misaligned and thus difficult, if not impossible, to open in a short time required in the event of an emergency. Gate assemblies for use at secure areas should provide certain means for preventing unauthorized access or ingress to a restricted or secure area, and further provide reliable keyless or tool-less exit or egress from the secure area. Some of the more pertinent prior art relating to gates, gate assemblies, and associated latch means are briefly described hereinafter.

U.S. Pat. No. 4,167,280 ('280 patent), which issued to Godec et al., discloses a panic exit latch and actuator mechanism including an elongated latch bolt actuator element rectilinearly movable along its axis and disposed in an elongated horizontally extending housing traversing a door. A push plate is supported for movement outwardly and inwardly relative to the housing. A pair of bell cranks provides an operative connection between the push plate and the actuator element to move the actuator element from its latch projected position to its latch retracted position in response to inward movement of the push plate. The bell cranks are mounted for pivotal movement about their apices in the housing, one crank being mounted adjacent either end of the housing. The pivotal axes of the bell cranks extend generally transversely to the direction of motion of the latch bolt actuator element. Each bell crank includes an arm pivotally connected to the latch bolt actuator element and arm pivotally connected to the push plate.

U.S. Pat. No. 4,630,396 ('396 patent), which issued to Zvi et al., discloses a security gate apparatus for securing building openings in the nature of window and door openings are disclosed; and comprise a security gate including gate-carried locking means which, while of particularly sturdy construction and effective to render it extremely difficult if not impossible as a practical matter to open the security gate from without the building opening, are nonetheless virtually foolproof in operation, and which are very readily and conveniently openable from within the building, even by those of somewhat limited mental and/or physical capacities, in readily apparent manner to thereby insure virtually immediate exit from the building through the building opening for the building occupants in emergency situations. Fixed security means are operatively associated with the security gate, and are of readily and conveniently adjustable extent; to thereby enable the ready adjustment in situ of the size of the security gate apparatus, and provide for significant versatility of application of the security gate apparatus with regard to the range of sizes of the building openings which may be effectively secured thereby.

U.S. Pat. No. 4,631,528 ('528 patent), which issued to Handel et al., discloses an emergency exit device of the push bar type to control entry and exit of personnel, including a crossbar which may be pushed toward a door to actuate mechanisms which retract a latch bolt, and an alarm and key system for selective alarm actuation. The alarm and key system includes internal control mechanisms which are mounted in a tamper-proof housing, which may be accessed only by operating the push bar and actuating the alarm. A light emitting diode in the alarm assembly indicates alarm state, the presence of power, and a preset delay interval for alarm actuation. A variety of internal and external key operation configurations may be employed. A fastening arrangement for the exit device housing provides security against unauthorized manipulation of alarm components. Where mounting the alarm assembly within the exit device frame, an internal mounted guard member may include a protection flange to block access to the alarm.

U.S. Pat. No. 6,010,117 ('117 patent), which issued to Doxey, discloses a door locking system for attachment to an outwardly opening door which engages the door frame and which has a panic bar movable towards the door for disengaging the locking system. The locking device includes an outer sleeve fixedly mounted to the interior surface of the door and extending over one side of the door frame. An inner sleeve is provided within the outer sleeve which is pulled against a spring to a door frame engagement position, wherein inner sleeve extends over the other side of the door frame to prevent the door from being opened. A catch on the panic bar retains the inner sleeve in the engagement position, and movement of the panic bar towards the door causes the inner sleeve to retract into the outer sleeve, thereby allowing the door to be opened.

U.S. Pat. No. 6,102,451 ('451 patent), which issued to Merryman, discloses a door latch push bar assembly for providing a push bar for unlatching a door latch such as the type found on storm doors. The door latch push bar assembly includes a mounting bracket and an elongate rod having a pair of opposite ends. A first of the ends of the rod is pivotally coupled to the mounting bracket. The mounting bracket is designed for mounting to a door adjacent a first side of the door. A second of the ends of the rod is designed for extending towards a second side of the door and for receiving a free end of pivotable lever of a latch adjacent the second side of the door releasably engaging the second side of the door to an adjacent portion of a door frame.

U.S. Pat. No. 6,145,897 ('897 patent), which issued to Locher, discloses a push-bar for doors in general, which comprises a bar element provided, at its ends, with couplings for connection to a door; the particularity of said push-bar is the fact that it is provided with a threaded bar which is arranged inside the bar element, each end of said bar element being connected to lever means which are in turn pivoted at one end to the bar element and, at the other end, to a pusher whose rotation as a consequence of a pressure applied to the bar element causes the rotation of a pawl which is adapted to engage the pivot of the lock of the door in order to turn it for opening, an empty space being provided between the bar element and the surface of the door to which the bar element is connected U.S. Pat. No. 5,765,411 ('411 patent), which issued to Rowan, discloses a security bar that can be retrofitted onto a gate used in a typical fence construction to prevent unauthorized tampering with or opening of the gate. The device includes a rigid locking bar that is firmly mounted to the gate, a T-shaped strike plate, and a key-actuated latchbolt mechanism mounted within the inside of the rigid locking bar so that the latchbolt and strike plate cannot be accessed for tampering. The strike plate is mounted to a conventional fence post with fasteners that are not accessible when the gate is closed. Using the present device, which can be retrofitted to any type of outdoor gate, a positive locking action insures that the gate is locked at all times and cannot be jimmied or pulled upward to a position that would allow it to be opened. The locking mechanism allows access from either side of the gate for actuation.

It may thus be seen that the prior art perceives a need for a gate assembly having means for preventing gate assembly misalignments as originating from ground deformations and the like. Therefore, it is an object of the present invention to provide a high security gate assembly having means for preventing gate assembly misalignments, for preventing keyless entry or ingress into a secure area, and for enabling keyless or tool-less exit or egress from a secure area as set forth in more detail hereinafter.

SUMMARY OF THE INVENTION

The present invention essentially discloses a gate assembly for preventing keyless ingress into, and enabling keyless (emergency) egress from a gated area. To achieve these and other readily apparent objectives, the gate assembly of the present invention essentially comprises a gate frame and a gate. The gate frame comprises vertical, laterally-opposed frame members, a horizontal superior frame member, and a horizontal inferior frame member. The frame members thus form a rectangular structure defining a planar gate-receiving area. The gate comprises vertical, laterally-opposed gate portions, a horizontal superior gate portion, and a horizontal inferior gate portion. The gate portions thus form a rectangular structure and define a planar frame-engaging area. Notably, the gate-receiving area is greater in magnitude than the frame-engaging area thereby further defining an inferior gate-frame gap, a superior gate-frame gap, and laterally opposed gate-frame gaps.

The gate further comprises certain exterior latch means, certain interior latch means, an exterior gate surface, an interior gate surface, and certain gate-to-frame attachment means for pivotally attaching the gate to the gate frame. The inferior frame member anchors the gate frame in subterranean ground at a member-buried depth and maintains the gate-receiving area during ground deformations. The member-buried depth operates to enable an installer to decrement the inferior gate-frame gap and form a gate-ground gap by burying the inferior gate frame member with ground matter or material. The exterior latch means preferably comprises keyed-entry means. Together, the keyed-entry means and the gate-to-frame gaps may well function to prevent keyless ingress into the secure area. The interior latch means preferably comprise certain push-structure-exit means. Together, the push-structure-exit means and gate-frame attachment means primarily function to enable push structure egress from the gated area.

The frame assembly of the present invention may preferably be ladder-shaped (having a centralized rectangular portion). The vertical, laterally-opposed frame members thus have superior member ends and inferior member ends. The inferior member ends may well function to enhance anchored insertion in ground-based media and the superior member ends may well function to receive barbed structure for preventing climbing access to the secure area over the fence and/or gate assembly of the present invention. The exterior gate surface may further comprises certain gate-frame gap shielding means for shielding the gate-frame gap(s) intermediate the gate and gate frame at the exterior latch means and along the periphery of the gate-to-frame junction. Further, the gate assembly may comprise certain gate plane-shielding means such as gate-mounted paneling or mesh for preventing access to the fenced area via the plane of the gate.

BRIEF DESCRIPTION OF THE DRAWINGS

Other features of my invention will become more evident from a consideration of the following brief description of patent drawings.

DETAILED DESCRIPTION OF THE PREFERRED EMBODIMENT(S)

Figure 1:
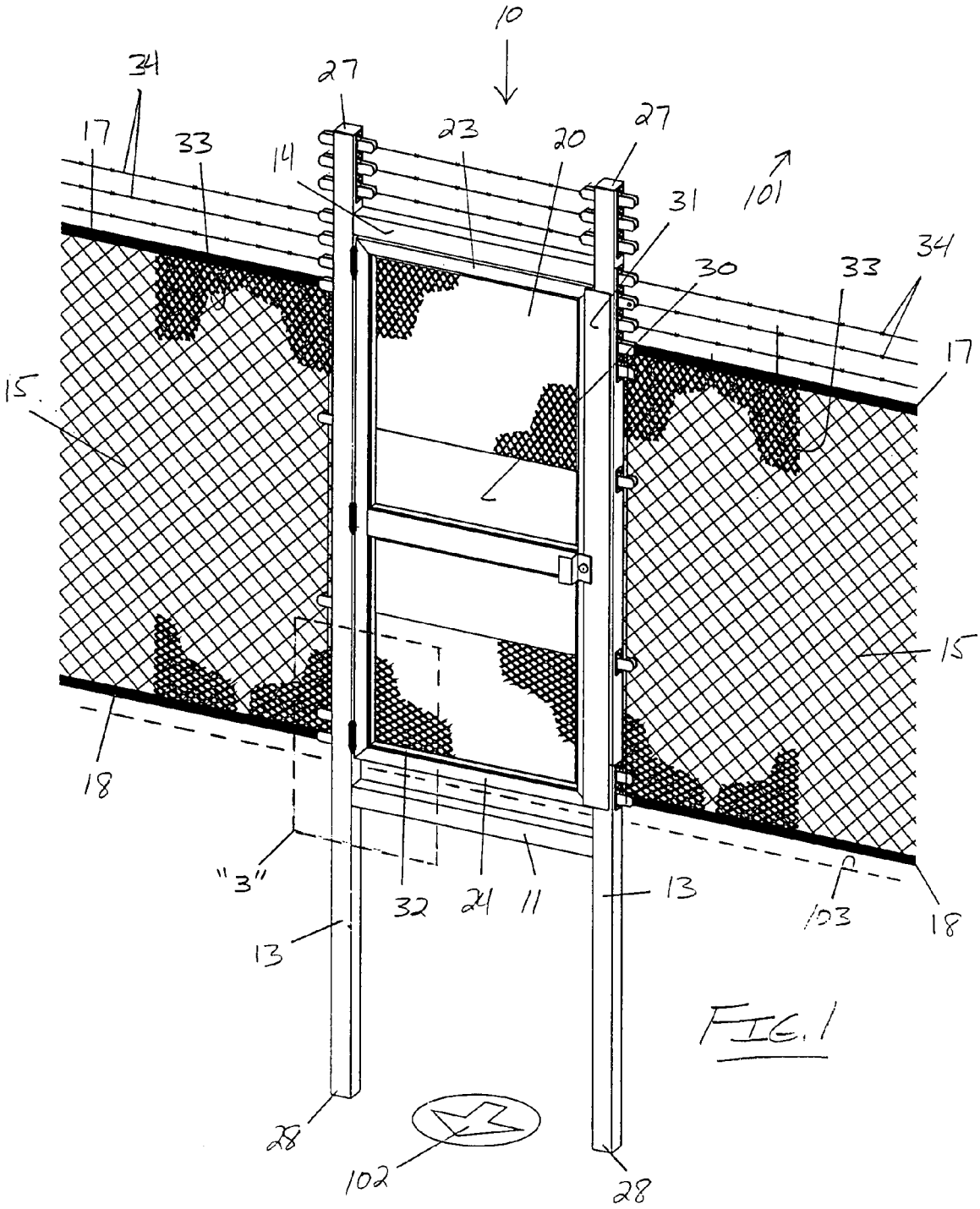
FIG. 1 is a fragmentary exterior perspective view of a fence-mounted gate assembly of the present invention as viewed exteriorly relative to a secure area with ground matter portions removed for clarity of reference.

Referring now to the drawings, the preferred embodiment of the present invention generally concerns a high security gate assembly for fenced, secure area installations such as refineries, gas pipeline sites, prisons, schools, and other areas of commercial and industrial construction. Gate assemblies for these types of installations oftentimes require means for preventing unauthorized access or ingress into the secure area, but further require means for enabling quick, keyless egress therefrom. For example, while the notion of enabling authorized persons to enter restricted or secure areas is perhaps readily understandable, it is less well understood that those authorized persons may require a quick escape route from the restricted or secure area in the event of an unsafe situation. Persons placed in danger within a secure environment ought to not be required to find a key to unlock a key-receiving lock in order to gain egression from the restricted area. The high security gate assembly 10 of the present invention has been designed with these and other features in mind. The gate assembly 10 of the present invention is generally illustrated and referenced in FIGS. 1-4.

A further design feature of the present invention attempts to remedy the fact that dynamic environmental conditions often compromise the integrity of gating systems. In this regard, it is noted that ground deformations such as sagging, settling, frost-thaw expansions and contractions, and earthquakes, as well as normal wear and tear often contribute to misalignments between the gate and gate frame thereby enabling easier access to the secure area by unauthorized entrants (as for example, by increasing gate-to-frame gaps and/or disengaging gate latch means) or preventing emergency egress from the secure area (as for example, by preventing motion of the gate by way of newly found stop structure of a misaligned gate frame).

Figure 5:
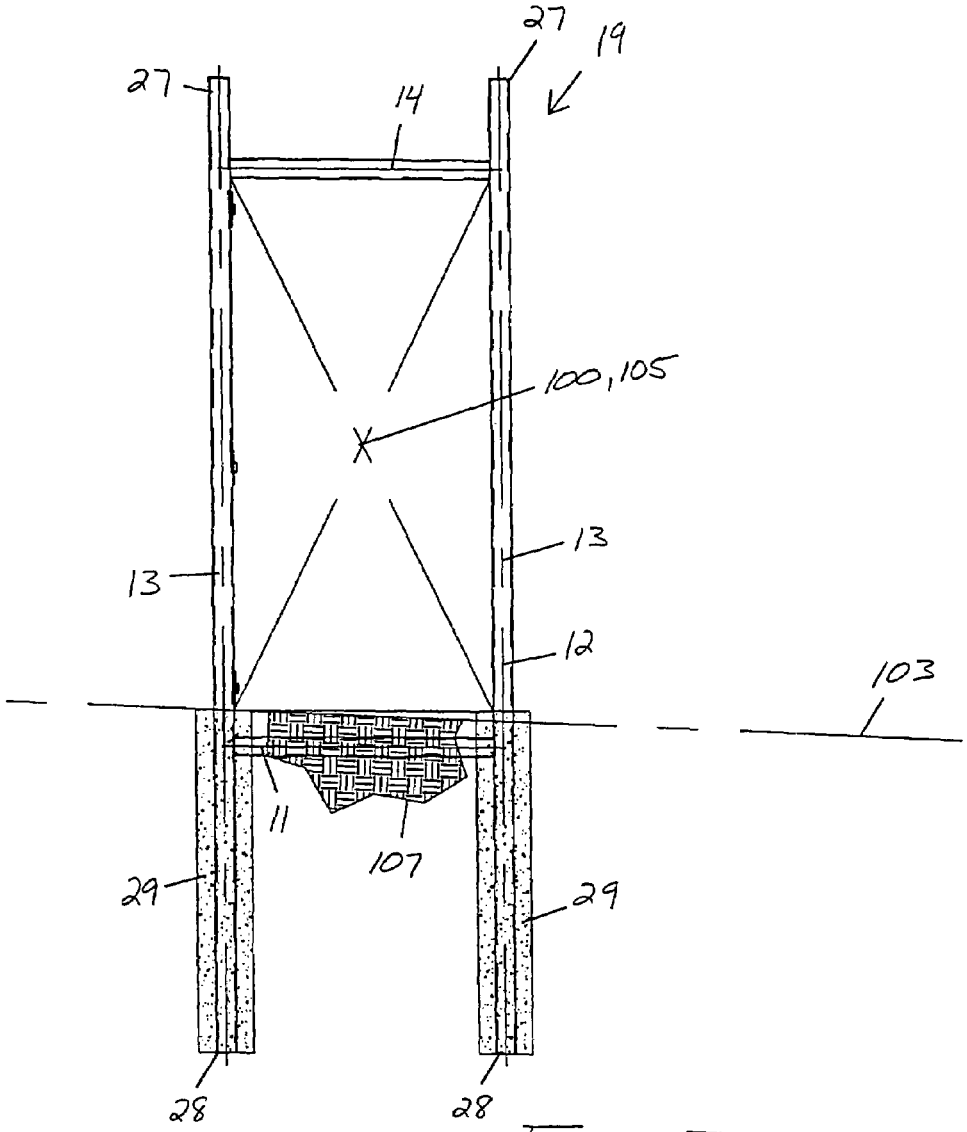
FIG. 5 is a fragmentary plan view type depiction of a gate frame of the present invention as supported by dynamic ground media, the dynamic ground media displacing the gate assembly from a horizontal orientation, an inferior gate frame member maintaining the gate frame in a rectangular configuration.

In this regard, the reader is directed to FIG. 5. From a consideration of FIG. 5, it may be understood that ground swells and the like may cause the anchoring sites receiving gate frame members to become otherwise displaced from a planar vertical-horizontal configuration. It is contemplated that by incorporating a subterranean inferior gate frame member 11 as a cross member support at the inferior end of the vertical gate frame members 13 (in addition to a superior gate frame member 14 functioning as a cross member support at the superior end of the vertical gate frame members 13), a rectangular gate frame 12 of sturdier construction is achieved. In other words, the ground media in which gate frames are typically anchored may be, and often are dynamic in nature, causing gate framing to become misaligned and thus corrupting the integrity of the gate assembly (enabling unauthorized access or preventing safe egress). The gate assembly of the present invention attempts to remedy this problem.

Figure 6:
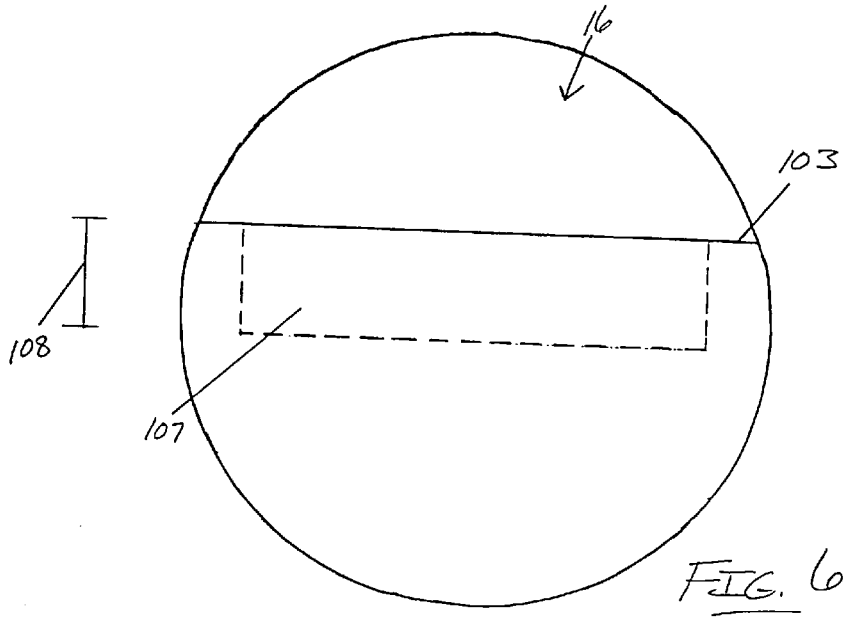
FIG. 6 is a first sequential fragmentary diagrammatic type depiction of a gateway located ground surface showing a matter removal volume in broken lines.

Prior art gate-framing means may comprise a superior cross member such as superior gate frame member 14, and usually vertical gateway defining uprights. Forces directed against said members by way of dynamic ground deformations may easily displace the members out of 90 degree or orthogonal alignment(s). The prior art thus perceives a need for an inferior gate frame member 11, which gate frame member 11 may well function to maintain the gate frame 12 in a substantially rectangular state (as generally depicted in FIG. 6 and referenced at 100) for maintaining the preferred gate to gate frame gap allowances and preventing unauthorized access to the secure area as generally depicted and referenced at 101 in FIG. 1, 2, and 4. It is thus contemplated that the present invention essentially teaches or supports the inventive concept of a secure area-fencing or gating system and gate assembly for preventing keyless ingress into, and enabling keyless egress (as at vector arrow 102 in FIGS. 1, 2, and 4) from, a secure area 101. In this regard, the secure area-fencing system of the present invention is believed to essentially comprise a fence 15 as generally illustrated and referenced in FIGS. 1-3; and the gate assembly 10 as generally illustrated and referenced in FIGS. 1-4.

Figure 3:
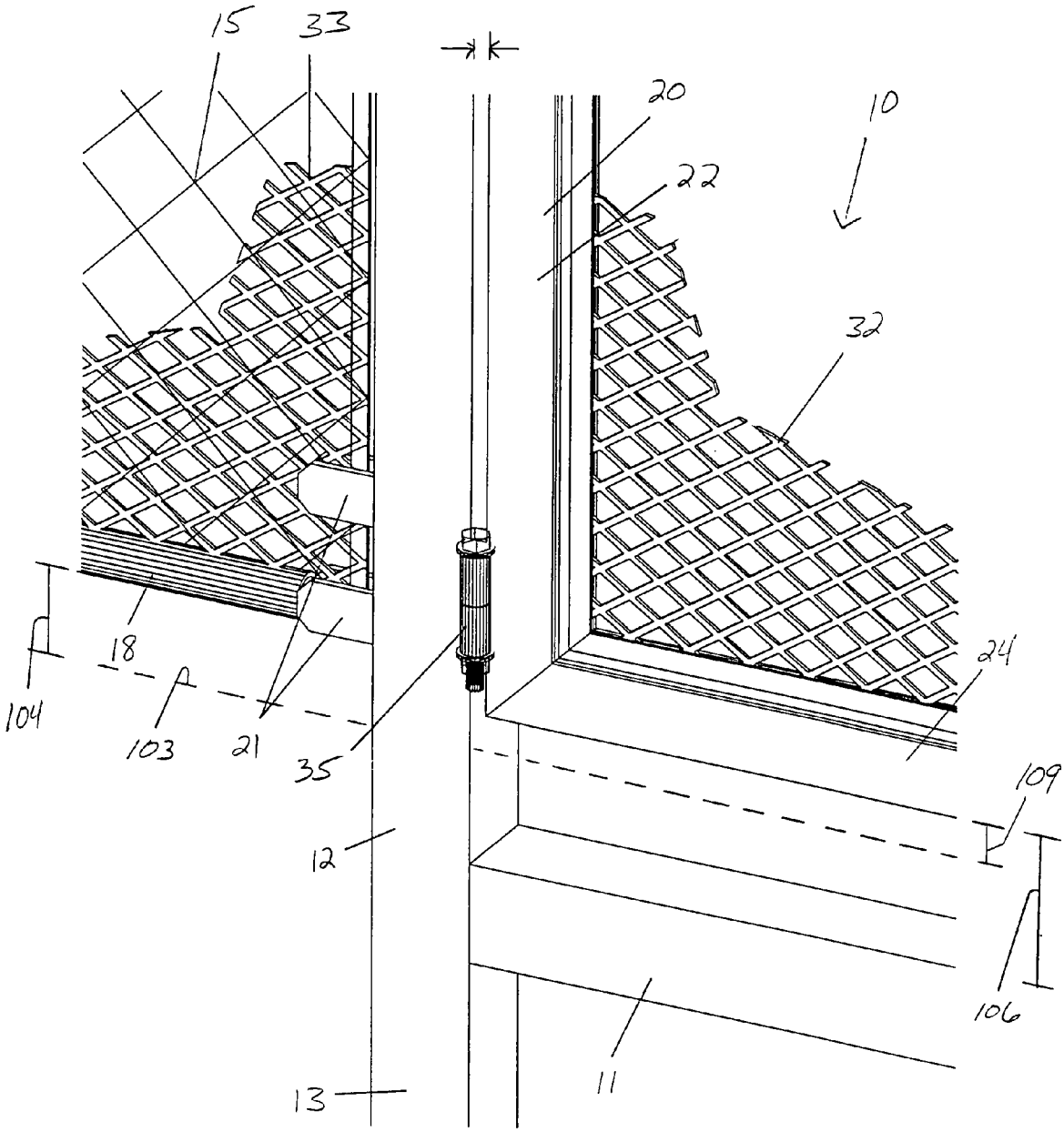
FIG. 3 is an enlarged fragmentary sectional perspective view of lower left portions of the fence-mounted gate assembly otherwise depicted in FIG. 1.

The fence 15 usable in combination with the gate assembly 10 of the present invention functions to bounding a peripheral majority of the secure area 101 in superior adjacency to a ground surface 103 as referenced with broken lines in FIGS. 1, 3, and 5, and as referenced with solid lines in FIGS. 6-9. The fence 15 thus defines a fence-ground gap at the fence-to-ground interface as at 104 in FIG. 3. It may be readily understood from an inspection of the noted figures that the fence 15 preferably has a vertical fence orientation and a gateway as at 16. It may be further understood that the gateway 16 is essentially that region defined by the terminal ends of fence 15. The vertically oriented fence 15 further preferably comprises a superior fence portion 17 and an inferior fence portion 18. The superior and inferior fence portions 17 and 18 are laterally opposed and preferably respectively collinear at the gateway 16. Further, the fence 15 is laterally opposed and preferably substantially coplanar at the gateway 16.

Figure 2:
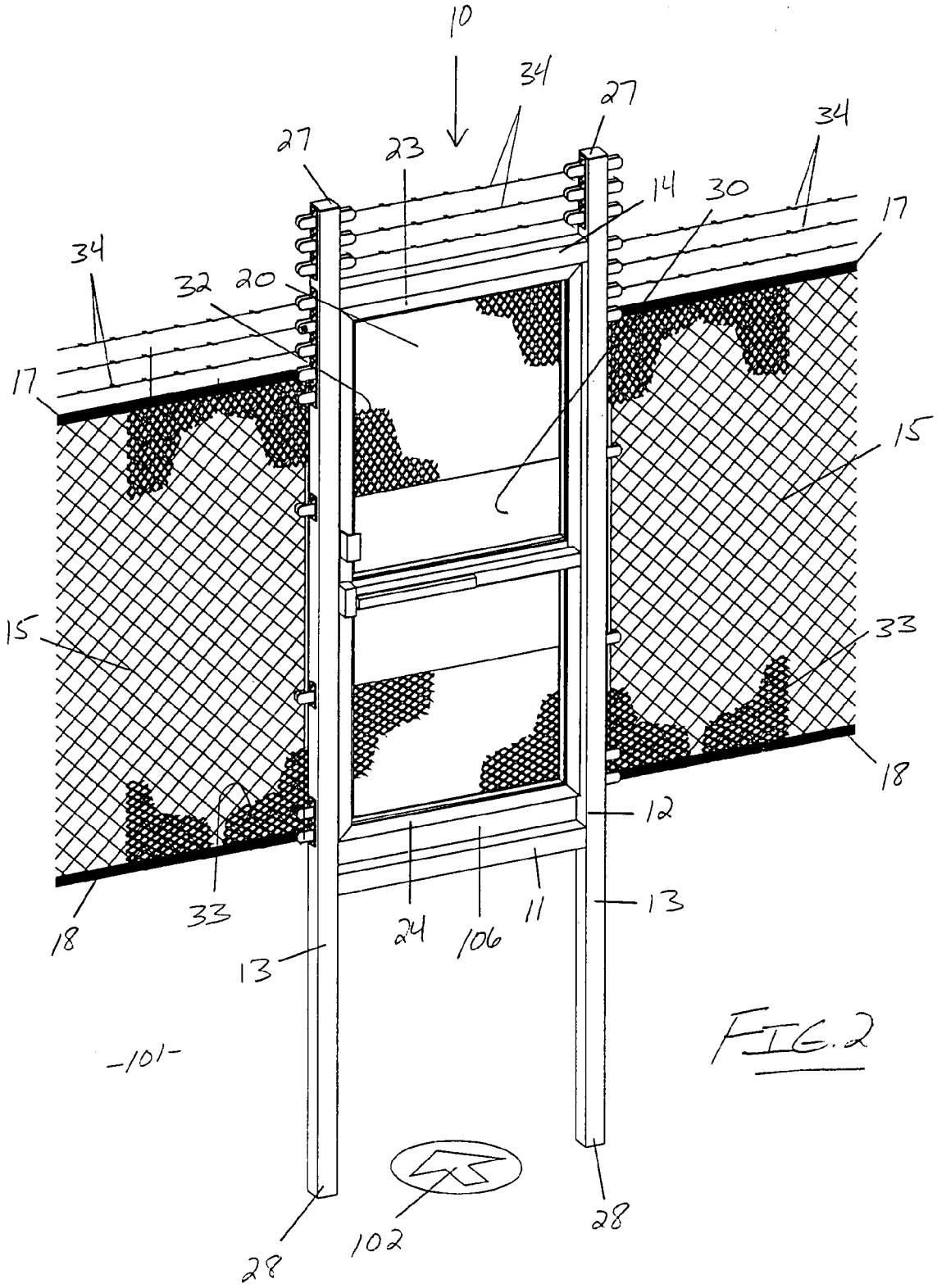
FIG. 2 is a fragmentary interior perspective view of a fence-mounted gate assembly of the present invention as viewed interiorly relative to a secure area with ground matter portions removed for clarity of reference.

The gate assembly 10 is received in the gateway 16 and comprises a rectangular gate frame 12 as illustrated and referenced in FIGS. 2, 3, and 5; a gate 20 as illustrated and referenced in FIGS. 1-4; and certain state of the art fence-to-frame or fence-frame attachment means for fixedly attaching the fence 15 to the gate frame 12. It is contemplated that the fence-frame attachment means may be preferably defined by adjustable and tamper resistant metal brackets 21 for tie-ins as generally depicted and referenced in FIG. 3. As earlier specified, the gate frame 12 of the present invention preferably comprises vertical, laterally opposed frame members 13, a horizontal superior frame member 14, and a horizontal inferior frame member 11. The frame members 11, 13, and 14 are preferably constructed from substantially rigid metallic stock material(s) (e.g. galvanized steel) and together define a planar or two-dimensional gate-receiving area as generally depicted in FIG. 5 at 105.

It is further contemplated that the superior and inferior horizontal members 14 and 11 connect the laterally opposed vertical members 13 intermediate the length thereof (as opposed to the ends thereof) and thus forms a ladder-shaped gate frame 19 as generally depicted and referenced in FIG. 5. It may be seen from an inspection of FIG. 6, as well as from a consideration of certain other figures, that the vertical members 13 may preferably comprise superior member ends 27 and inferior member ends 28. It is contemplated that the inferior member ends 28 may well function to further anchor the gate frame 12 in subterranean ground 107. In this regard, it is contemplated that certain anchoring or anchor-reinforcing means, such as concrete 29 or the like, may well function to enhance anchored mounting of the inferior member ends 28 in the subterranean ground 107.

Figure 4:
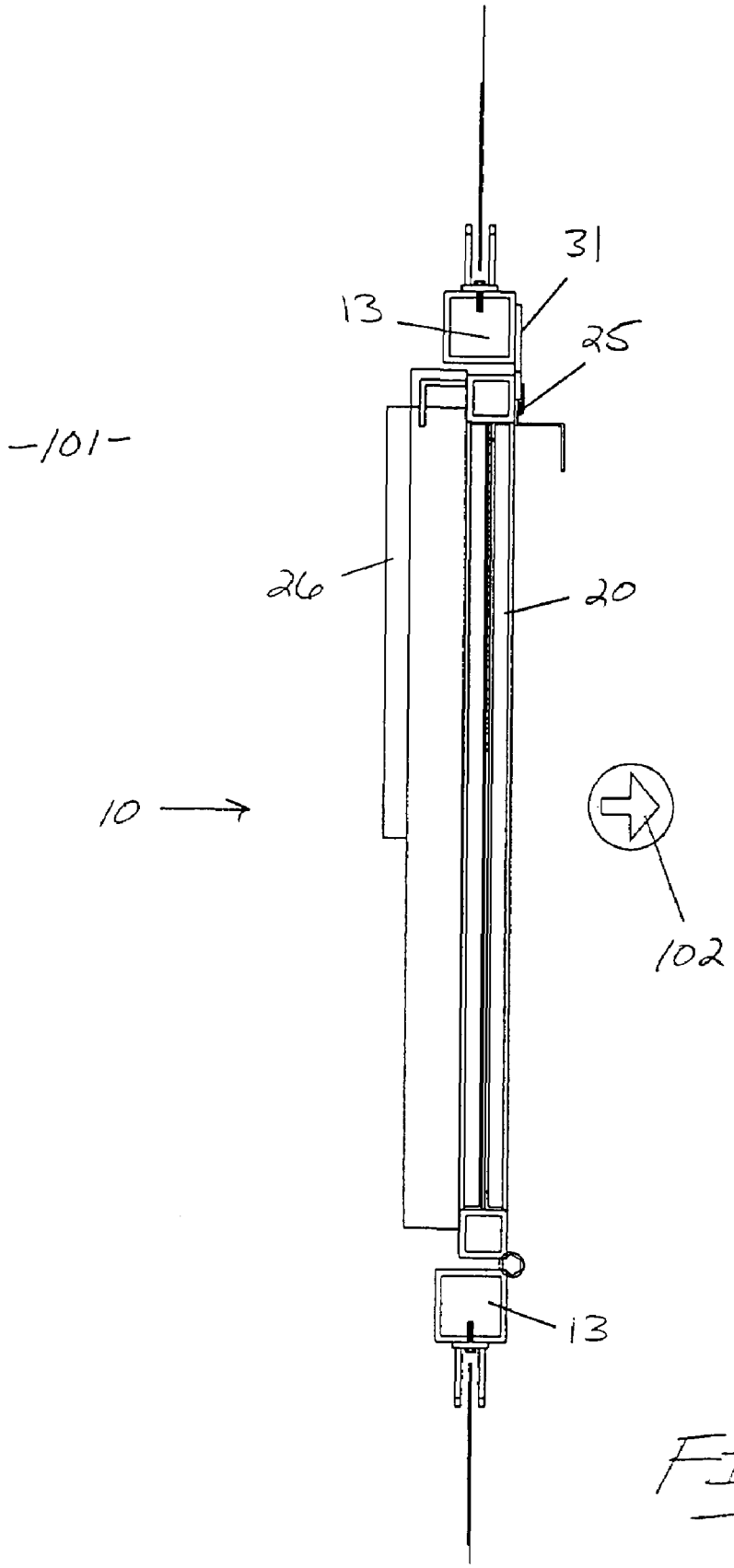
FIG. 4 is a top view type depiction of the gate assembly of the present invention with certain portions removed to show latching means and depicting a left to right egress path.

The gate 20 preferably comprises vertical, laterally-opposed gate portions 22, one of which is illustrated and referenced in FIG. 3; a horizontal superior gate portion 23 as illustrated and referenced in FIGS. 1 and 2; a horizontal inferior gate portion 24 as illustrated and referenced in FIGS. 1-3; certain exterior latch means as generally depicted in FIGS. 1 and 4; certain interior latch means as generally depicted in FIGS. 2 and 4; an exterior gate surface as generally depicted in FIGS. 1 and 3; an interior gate surface as generally depicted in FIG. 2; and certain gate-to-frame or gate-frame attachment means for pivotally attaching the gate 20 to the gate frame 12. The gate-to-frame attachment means may be preferably defined by stainless steel hinge assemblies 35 for providing rust-free operation as generically illustrated and referenced in FIG. 3. Together, the gate portions 22, 23, and 24 define a planar frame-engaging area. Further, the inferior gate portion 24 is preferably substantially collinear with the inferior fence portions 18 for preventing unauthorized access to the secure area 101 via uniformly dimensioned fence-to-ground or and gate-to-ground gaps.

It is contemplated that the exterior gate surface may preferably comprise certain gate-to-frame gap or gate-frame gap shielding means for shielding the gate-frame gap intermediate the gate 20 and gate frame 12 at the exterior latch means. In this regard, the preferred gate-frame gap means may be defined by a tamperproof guard plate 30 as illustrated and referenced in FIGS. 1 and 2; and a tamperproof guard plate 31 as illustrated and referenced in FIGS. 1 and 4. The guard plate 30 is essentially attached to the plane of the gate 20 intermediate the vertical, laterally-opposed gate portions 22 in vertical adjacency to the latch means. The guard plate 31 is essentially attached to the exterior surface of one of the gate portions 22 such that when the gate 20 is closed, the guard plate covers the longitudinal gate-frame gap in vertical adjacency to the latching junction (not specifically illustrated).

It is contemplated that the gate-frame gap means essentially function to close or otherwise shield the gate-to-frame gaps for preventing unauthorized access to the secure area 101 via the gate-frame gaps. In other words, the guard plates 30 and 31 cover or shield the gate-to-frame gaps so that unauthorized entrants may not manipulate the interior latch means with the use of a tool insertable through the gaps or insertable through the plane of the gate 20. In this last regard, it is further contemplated that the gate 20 may preferably comprise certain gate plane-shielding means for preventing access (whether authorized or unauthorized) to the secure area 101 via the plane of the gate 20. In other words, it is contemplated that the integrity of the gate 20 and gate frame 12 are critical to the function of the gate assembly 10. No access to secure area 101 should thus be enabled by the gate assembly 10 other than by way of the latch means and pivoting action of the gate 20 relative to the gate frame 12.

In addition to the functionality of the guard plate 30 for preventing access to the secure area 101 by way of the gate plane, it is contemplated that the gate plane-shielding means may also be defined by certain gate-mounted paneling 32, which may be either of a solid or mesh variety, as generally illustrated in fragmentary form (for clarity of reference) and referenced in FIGS. 1-3. It is contemplated that the mesh variety may be preferred insofar as it enables visual sighting through the plane of the gate 20. In keeping with this notion, it is further contemplated that the fence 15 may preferably comprise certain fence plane-shielding means for preventing access to the secure area 101 via the plane of the fence 15, which fence plane-shielding means may be preferably defined by solid or mesh paneling 33 and cooperably associated with the fence portions adjacent the gate assembly 10 as generally illustrated in fragmentary form (for clarity of reference) and referenced in FIGS. 1-3.

Further means for preventing access to the secure area by way of climbing over the fence 15 and gate assembly 10 are contemplated as bolstering the effectiveness of the present teachings. In this regard, it is contemplated that the superior fence portion 17 may preferably comprise certain barbed structure 34 as generically illustrated and referenced in FIGS. 1 and 2. As is well known in the art, barbed structure such as generically represented by barbed structure 34 may well function to prevent or hinder climbing access to the secure area 101 over the superior fence portion 17. In keeping with this notion, a peripheral gap in the barbed 34 structure may exist unless the gate assembly 10 also incorporates certain barbed structure. In this regard, the barbed structure 34 may well extend intermediate the superior member ends 27 for peripherally bounding the secure area 101 in superior adjacency to the fence 15 and gate assembly 10 for preventing climbing access to the secure area 101.

It is contemplated that the exterior latch means may preferably comprise certain state of the art key-to-lock or keyed-entry means. In other words, it is contemplated that the exterior interface of the gate 20 may comprise a keyed or key-enabled entry as at 25 in FIG. 4 for providing authorized entrants (carrying gate-opening keys) to gain entrance to or otherwise gain ingression to the secure area 101. When egression from the secure area 101 is sought, the interior latch means may be quickly and easily engaged. In this regard, it is contemplated that the interior latch means may preferably comprise certain push-operable exit means, such as a state of the art push bar 26 actuable latch mechanism or push button latch mechanism as commonly found on gates of areas requiring means for enabling safe and effective (emergent) gate-pushed egress as generally depicted and referenced in FIG. 4.

It may be seen from a comparative inspection of the noted figures that the gate-receiving area 105 of the gate frame 12 is greater in magnitude than the frame-engaging area of the gate 20. In other words, the gate frame 12 is sized and shaped to receive the gate 20 such that the frame-received gate 20 define an inferior gate-frame gap 106 as illustrated and referenced in FIG. 3; a superior gate-frame gap; and laterally opposed gate-frame gaps. The inferior frame member 11 is preferably buried in the subterranean ground matter 107 as generally depicted in FIG. 6 for anchoring the gate frame 12. In other words, the inferior frame member 11 anchors the gate frame 12 in subterranean ground 107 at a member-buried depth or depth 108 as generally depicted and referenced in FIGS. 6-9.

It is contemplated that the inferior frame member 11 may well function to maintain the gate-receiving area 105 during ground deformations of the type heretofore specified. Subterranean placement of the inferior frame member 11 may well function to anchor the gate frame 12 to the ground as well as maintain the gate-receiving area 105 during ground deformations. The member-buried depth 108 essentially closes the effective inferior gate-frame gap 106 and forming a gate-ground gap 109 as depicted and referenced in FIG. 3. It is thus contemplated that the keyed-entry means and the gate-to-frame gaps may well function to preventing keyless or unauthorized ingress into the secure area 101 and that the interior latch means and gate-frame attachment means primarily function to enable push structure egress from the secure area 101 via the gate 20.

While the above description contains much specificity, this specificity should not be construed as limitations on the scope of the invention, but rather as an exemplification of the invention. For example, it is contemplated that the present invention essentially discloses a fenced area-gating system for preventing keyless ingress into, and enabling quick, safe, and emergent keyless egress from, a fenced area incorporating the gate assembly 10. The fenced area-gating system of the present invention may thus be said to essentially comprise the gate assembly 10 receivable in a fence gateway (such as gateway 16) having laterally opposed coplanar fence portions (i.e. those fence portions optionally cooperable with paneling 33 as earlier specified).

The gate assembly essentially comprises a rectangular gate frame portion (as has been referenced at 12), a gate (such as gate 20), and certain fence-frame attachment means. The fence-frame attachment means function to attach the gate frame to the fence portions. The gate frame comprises vertical, laterally opposed frame members, a horizontal superior frame member, and a horizontal inferior frame member. The frame members define a planar gate-receiving area. The gate comprises vertical laterally-opposed gate portions, a horizontal superior gate portion, a horizontal inferior gate portion, exterior latch means, interior latch means, an exterior gate surface, an interior gate surface, and gate-frame attachment means. The gate-frame attachment means function to pivotally attach the gate to the gate frame, and the gate portions define a planar frame-engaging area.

The gate-receiving area of the gate frame is greater in magnitude than the frame-engaging area of the gate thereby defining an inferior gate-frame gap, a superior gate-frame gap, and laterally opposed gate-frame gaps. A single gate-frame gap is depicted and referenced at 110 in FIG. 3 and is contemplated to represent a model, uniform gate-to-frame gap (except, perhaps for the inferior gate-to-frame gap as at 106. The inferior frame member essentially functions to anchor the gate frame in subterranean ground at a member-buried depth and is designed to substantially maintain the gate-receiving area during ground deformations (by completing a 360 degree gate frame). The member-buried depth functions to close or decrement the inferior gate-frame gap and thereby forms a gate-ground gap (as at 109) on the same order of magnitude as gap(s) 110 (sized and shaped to prevent entrants and tools from gaining latch operating access to the interior latch means via the gap(s). The exterior latch means comprise keyed-entry means. Together, the keyed-entry means and gate-frame gaps may well function to prevent keyless ingress into the secure area. The interior latch means preferably comprise certain push-structure-exit means, which are cooperable with certain gate-frame attachment means for enabling push structure egress from the fenced area via the gate.

It is contemplated that the inferior gate frame member 11 is central to the practice of the present invention. Said member primarily functions to maintain the planar form of and magnitude of the gate-receiving area, which form and area may become otherwise altered via dynamic ground deformations and normal wear and tear of the gate assembly. The inferior gate frame member further contributes to the installation of the gate assembly 10, however, insofar as it provides a linear or planar structure that may be aligned with underlying horizontally leveled substructure for properly orienting or positioning the gate assembly 10 relative to the fence 15. In this regard, it is contemplated that the foregoing teachings further support certain gate (assembly) positioning methodology for maintaining a leveled gate frame.

Figure 7:
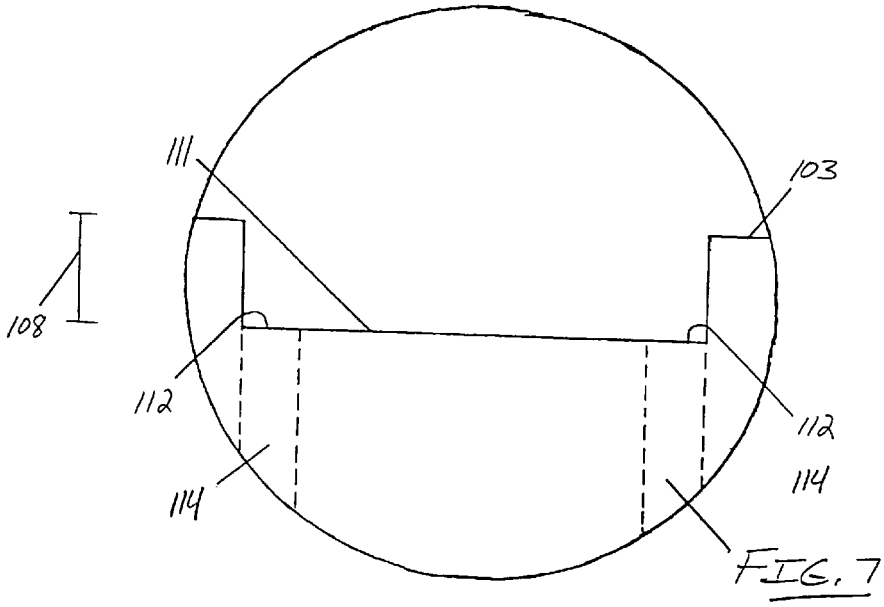
FIG. 7 is a second sequential fragmentary diagrammatic type depiction of a gateway located ground surface showing (1) a decremented, horizontally level ground surface following removal of the matter removal volume otherwise depicted in FIG. 7, and (2) vertical member-receiving portions in broken lines.
Figure 8:
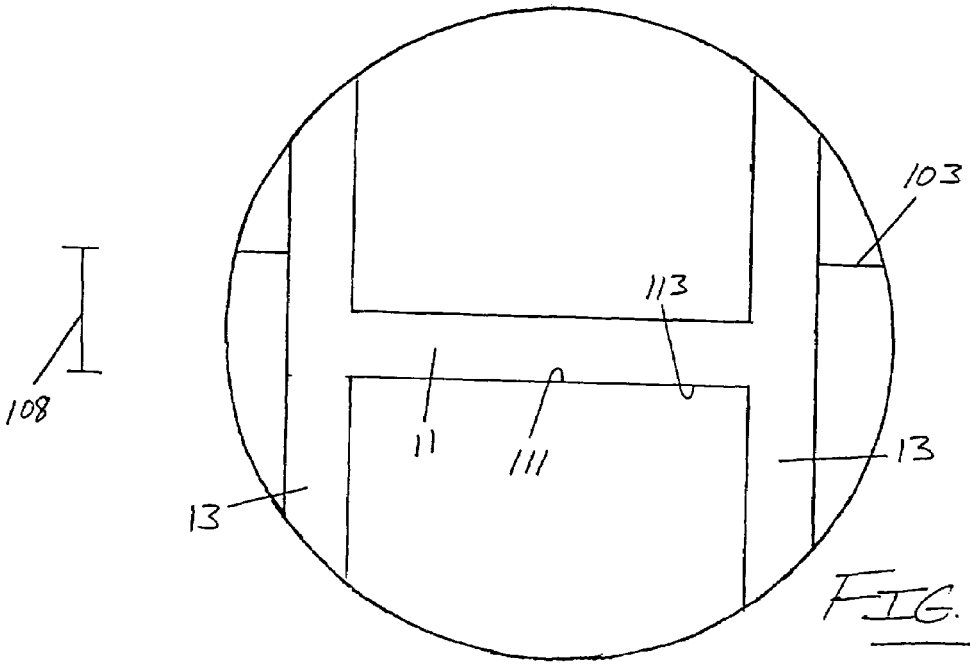
FIG. 8 is a third sequential fragmentary diagrammatic type depiction of (1) the inferior gate frame member of the gate frame being horizontally leveled by the decremented, horizontally level ground surface and (2) the inferior ends of vertical frame members of the gate frame being received in the vertical member-receiving portions otherwise shown in FIG. 8.
Figure 9:
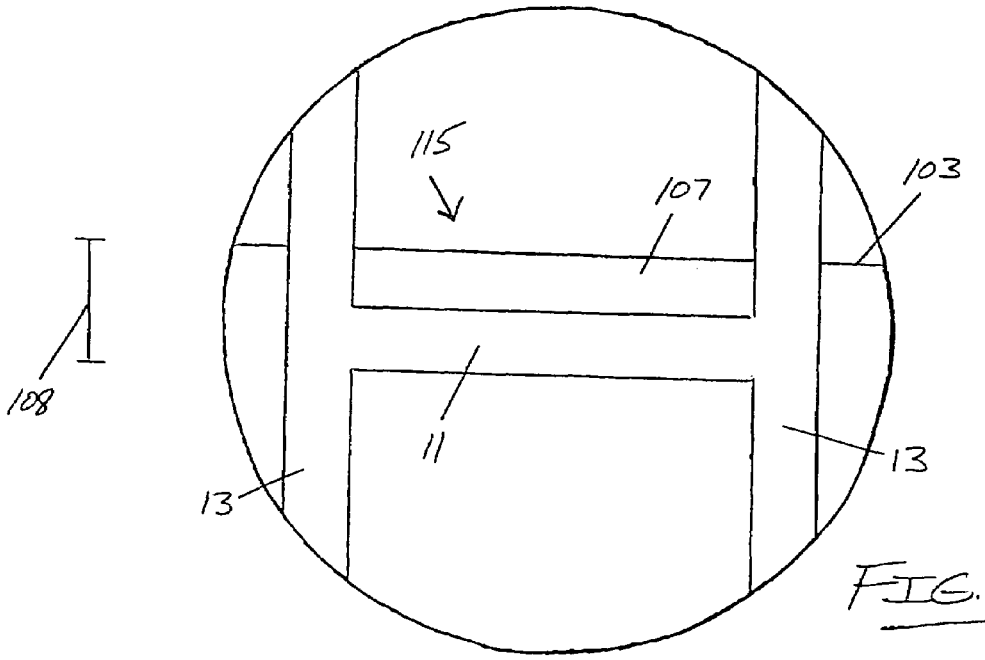
FIG. 9 is a fourth sequential fragmentary diagrammatic type depiction of (1) the inferior gate frame member and the inferior ends of vertical frame members of the gate frame being anchored at the gateway located ground surface with ground matter burying the inferior gate frame member and the inferior ends of the vertical frame members.

In this last regard, it is contemplated that the gate positioning method of the present invention may essentially comprise an initial step of removing ground matter 107 inferior to a gateway 16 as comparatively depicted in FIG. 6 versus FIG. 7. From an inspection of the noted figures, it may be seen that the removal of ground matter 107 operates to form a decremented ground surface as at 111 in FIG. 7. The ground surface may be compacted and horizontally leveled with certain backfill type material for properly supporting a gate frame. In other words, the decremented ground surface 111 is horizontally leveled intermediate laterally opposed surface portions as at 112 in FIG. 7.

After horizontally leveling the decremented ground surface 111, the inferior gate frame member 11 (orthogonally extending intermediate vertical gate frame members 13) may be positioned thereupon. Notably, the horizontally leveled decremented ground surface 111 is substantially planar (as may be gleaned from FIG. 7) and the inferior gate frame member 11 is preferably linear at least at those portions interfacing with the surface 111. The methodology may thus be said to essentially comprise the step of positioning a horizontal inferior gate frame portion upon the horizontally leveled ground surface at a substantially planar frame-ground interface as at 113 in FIG. 8.

Should the vertical laterally-opposed frame members 13 comprise extended inferior frame ends 28, the same ends 28 may be received in member-receiving portions 114 (optionally filled or otherwise cooperable with certain frame-anchoring or reinforcement means (such as concrete) after inserting member ends 28 during the step of positioning the member 11 upon the surface 111. Notably, the member-receiving portions 114 would need to be excavated at or about the step of removing ground matter 107 to form the decremented ground surface 111. After the frame member(s) are positioned, the inferior gate frame portion (as at 11) may be buried with ground matter 115 (such as backfill material, concrete, or earth) as generally depicted and referenced in FIG. 9. It may be gleaned from an inspection of FIG. 9 that the act of burying member 11 functions to conceal and anchor the inferior gate frame portion in subterranean properly positioned placement. The inferior gate frame portion may complete a vertically oriented 360 degree gate frame, which frame defines a planar frame area. Thus, after burying (concealing and anchoring) the inferior gate frame portion, the inferior gate frame portion may well function to further maintain a leveled gate frame (for example, during forceful (ground) frame deformations.

Further, it is contemplated that the foregoing teaches essentially support a gate assembly for preventing keyless ingress into, and enabling keyless egress from a gated area. The gate assembly may be said to essentially comprise a gate frame, a gate, and means for operably attaching the gate to the gate frame. The gate frame comprises a planar gate-receiving area and means for maintaining the planar gate-receiving area such as the 360 degree construction of the gate frame and/or the combination of an inferior gate frame member extendable intermediate laterally-opposed gate frame members and concealable in subterranean ground. The gate comprises a planar frame-engaging area, exterior latch means, and interior latch means. Notably, the gate-receiving area is greater in magnitude than the frame-engaging area for operably receiving the gate. The exterior latch means essentially function to prevent keyless ingress into the secure area via the gate, and the interior latch means are function for enabling gate-pushed egress from the gated area via the gate.

Accordingly, although the invention has been described by reference to a preferred embodiment and a number of alternative embodiments, it is not intended that the novel system or gate assembly be limited thereby, but that modifications thereof are intended to be included as falling within the broad scope and spirit of the foregoing disclosure, the following claims and the appended drawings.

I claim:

1. An area-fencing system, the area-fencing system for preventing keyless ingress into, and enabling keyless egress from, an area, the area-fencing system comprising, in combination:

a fence, the fence for bounding a target area, the fence having a vertical fence orientation and a gateway, the vertically oriented fence comprising a superior fence portion and an inferior fence portion, the superior and inferior fence portions being laterally opposed and respectively collinear at the gateway, the fence being laterally opposed and coplanar at the gateway;

a gate assembly, the gate assembly being received in the gateway and comprising a gate frame, a gate, and fence-frame attachment means, the fence-frame attachment means for attaching the fence to the gate frame, the gate frame comprising laterally-opposed frame members, a superior frame member, and an inferior frame member, the frame members defining a planar gate-receiving area, the gate comprising laterally-opposed gate portions, a superior gate portion, an inferior gate portion, keyed-entry means, push-operable exit means, and gate-frame attachment means, the gate-frame attachment means for operably attaching the gate to the gate frame, the gate portions defining a planar frame-engaging area, the gate-receiving area being greater in magnitude than the frame-engaging area, the superior and inferior frame members connecting the laterally-opposed frame members intermediate the length thereof thus forming a ladder-shaped gate frame, the laterally-opposed frame members having superior member ends and inferior member ends, the inferior member ends for anchoring the gate frame in subterranean ground, the inferior frame member being concealable by ground matter and for maintaining the gate-receiving area during ground deformations, the keyed-entry means for preventing keyless ingress into the target area, the push-operable exit means for enabling gate-pushed egress from the target area.

2. The area-fencing system of claim 1 comprising gap-shielding means, the gap-shielding means for shielding gate-frame gaps intermediate the gate and gate frame and for preventing unauthorized access to the target area via gate-frame gaps.

3. The area-fencing system of claim 1 wherein the gate comprises gate plane-shielding means, the gate plane-shielding means for preventing access to the target area via the plane of the gate.

4. The area-fencing system of claim 3 wherein the fence comprises fence plane-shielding means, the fence plane-shielding means for preventing access to the target area via the plane of the fence.

5. The area-fencing system of claim 1 wherein the superior fence portion comprises barbed structure, the barbed structure for preventing access to the target area via the superior fence portion.

6. The area-fencing system of claim 5 wherein the barbed structure extends intermediate the superior member ends, the barbed structure for preventing access to the target area via the superior member ends.

7. An area-gating system, the area-gating system for preventing keyless ingress into, and enabling keyless egress from, a fenced area, the area-gating system comprising:

a gate assembly, the gate assembly being received in a fence gateway, the fence gateway having laterally-opposed coplanar fence portions, the gate assembly comprising a gate frame, a gate, and means for attaching the gate frame to the fence portions, the gate frame comprising laterally-opposed frame members, a superior frame member, and an inferior frame member, the frame members defining a planar gate-receiving area, the gate comprising laterally-opposed gate portions, a superior gate portion, an inferior gate portion, exterior latch means, interior latch means, an exterior gate surface, an interior gate surface, and means for operably attaching the gate to the gate frame, the gate portions defining a planar frame-engaging area, the gate-receiving area being greater in magnitude than the frame-engaging area, the superior and inferior frame members connecting the laterally-opposed frame members intermediate the length thereof thus forming a ladder-shaped gate frame, the laterally-opposed frame members having superior member ends and inferior member ends, the inferior ends for anchoring the gate frame in subterranean ground, the inferior frame member being concealable by ground matter and for maintaining the gate-receiving area during ground deformations, the exterior latch means for preventing keyless ingress into the fenced area, the interior latch means for enabling gate-pushed egress from the fenced area.

8. The area-gating system of claim 7 wherein the exterior gate surface comprises gap-shielding means, the gap-shielding means for shielding gate-frame gaps intermediate the gate and gate frame for preventing unauthorized access to the fenced area via the gate-frame gaps.

9. The area-gating system of claim 7 herein the gate comprises gate plane-shielding means, the gate plane-shielding means for preventing access to the fenced area via the plane of the gate.

10. The area-gating system of claim 7 wherein the fence portions comprise barbed structure, the barbed structure for preventing access to the fenced area via the fence portions.

11. The area-gating system of claim 10 wherein the barbed structure extends intermediate the superior member ends, the barbed structure for preventing access to the fenced area via the superior member ends.

12. A gate assembly, the gate assembly for preventing keyless ingress into, and enabling keyless egress from a gated area, the gate assembly comprising:

a gate frame, a gate, and means for operably attaching the gate to the gate frame, the gate frame comprising laterally-opposed frame members, a superior frame member, an inferior frame member, a planar gate-receiving area and means for maintaining the planar gate-receiving area, the superior and inferior frame members connecting the laterally-opposed frame members intermediate the length thereof thus forming a ladder-shape gate frame, the laterally-opposed frame members having superior member ends and inferior member ends, the inferior member ends for anchoring the gate frame in subterranean ground, the gate comprising a planar frame-engaging area, exterior latch means, and interior latch means, the gate-receiving area being greater in magnitude than the frame-engaging area for operably receiving the gate, the exterior latch means for preventing keyless ingress into the secure area via the gate, the interior latch means enabling gate-pushed egress from the gated area via the gate.

13. The gate assembly of claim 12 comprising gap-shielding means, the gap-shielding means for shielding gaps intermediate the gate and gate frame and thus for preventing unauthorized access to the gated area.

14. The gate assembly of claim 12 wherein the gate comprises gate plane-shielding means, the gate plane-shielding means for preventing access to the gate area via the plane of the gate.

15. The gate assembly of claim 12 wherein barbed structure extends intermediate the superior member ends, the barbed structure for preventing climbing access to the fenced area over the gate assembly.

* * * * *